US006609813B1

(12) United States Patent
Showers et al.

(10) Patent No.: US 6,609,813 B1
(45) Date of Patent: Aug. 26, 2003

(54) HOUSING AND MOUNTING SYSTEM FOR A STRIP LIGHTING DEVICE

(75) Inventors: David Field Showers, Malvern (AU); James Barry Quantrell, Vermont South (AU)

(73) Assignee: Lumileds Lighting, U.S. LLC, San Jose, CA (US)

( * ) Notice: Subject to any disclaimer, the term of this patent is extended or adjusted under 35 U.S.C. 154(b) by 0 days.

(21) Appl. No.: 09/856,806

(22) PCT Filed: Nov. 24, 1999

(86) PCT No.: PCT/AU99/01044

§ 371 (c)(1),
(2), (4) Date: Sep. 6, 2001

(87) PCT Pub. No.: WO00/31463

PCT Pub. Date: Jun. 2, 2000

(30) Foreign Application Priority Data

Nov. 24, 1998 (AU) ..... PP 7292

(51) Int. Cl.[7] ..... F21V 1/00

(52) U.S. Cl. ..... 362/240; 362/223; 362/249; 362/361; 362/362; 362/363; 362/812; 362/800; 40/550; 40/558

(58) Field of Search ..... 362/146, 240, 362/246, 219, 223, 102, 202, 184, 249, 252, 351, 361, 362, 368, 370, 812, 800; 40/550, 558, 549; 340/815.73

(56) References Cited

U.S. PATENT DOCUMENTS

| | | | | | |
|---|---|---|---|---|---|
| 3,894,225 | A | | 7/1975 | Chao | 240/1 R |
| 4,376,966 | A | | 3/1983 | Tieszen | 362/249 |
| 4,761,720 | A | | 8/1988 | Solow | 362/252 |
| 5,099,401 | A | * | 3/1992 | Kondo et al. | 362/240 |
| 5,161,882 | A | | 11/1992 | Garrett | 362/249 |
| 5,438,804 | A | * | 8/1995 | Reum et al. | 362/249 |
| 5,453,917 | A | * | 9/1995 | Ogawa | 362/219 |

FOREIGN PATENT DOCUMENTS

| | | |
|---|---|---|
| WO | WO 88/01360 | 2/1988 |

* cited by examiner

*Primary Examiner*—Stephen Husar
(74) *Attorney, Agent, or Firm*—Patent Law Group LLP

(57) ABSTRACT

A housing and mounting system for a strip lighting device, particularly a lighting device of the kind in which multiple light emitting diode (LED) light sources are arranged at spaced intervals within an elongate tubular housing that is translucent and arranged to diffuse, disperse or scatter the light from the LED light sources. The tubular housing has two longitudinally extending keys integrally formed on the exterior of the tube. The interior of the tube has longitudinally extending formations for supporting mounted LED light sources within the tube.

23 Claims, 14 Drawing Sheets

HOUSING AND MOUNTING SYSTEM FOR A STRIP LIGHTING DEVICE

FIELD OF THE INVENTION

This invention relates generally to a housing and mounting system for a strip lighting device, especially but not exclusively a lighting device of the kind in which multiple light emitting diode (LED) light sources are arranged at spaced intervals within an elongate housing that is translucent and arranged to diffuse, disperse or scatter the light from the LED light sources.

BACKGROUND ART

The present applicant's international patent application PCT/AU98/00602 discloses a strip lighting device in which multiple LED light sources are arranged at intervals on a support strip within an extruded elongate housing. The housing is translucent and diffuses the light emitted by the LEDs, whereby the housing glows so as to form a strip or line of light. The housing has a base shaped to snap fasten onto complementary mounting rails that may be fastened along a wall or building feature. Although the essential concept has caused considerable interest, the form of housing disclosed and illustrated in our prior international patent application is limited in its applications because it is not easily formed into non-linear shapes and requires a backing flat surface for fixing the associated mounting rail. The housing is not well suited to highlighting complex architectural features or achieving other more complex shapes, and requires special connector pieces to go around building corners and the like.

Similar considerations apply to the housing disclosed in Japanese patent publication 09-258676. In that case, the elongated housing is formed in two parts, a base and a cover, and the light emitted by the LEDs (which stand up on the base) is dispersed or diffused by internally shaped surfaces.

The present applicant considered addressing the problem by utilising tubular housings of uniform circular cross-sections as a modification of its prior invention, which would apparently be possible given that the diffusion of the light is achieved by the body material of the housing rather than its internal or external profile. However, the preferred material for the housing is a polycarbonate plastic and it was found that attempts to extrude uniform tubes of this material result in an undesirable rotation of the moulding, unacceptable given that these are internal features of the tube such as for mounting the printed circuit board (PCB) strips on which the LEDs are supported.

It is therefore an object of the invention to achieve a housing for a strip lighting device which is more adaptable in its mounting than prior housings, and therefore broadens the range of applications of lighting devices of the above-discussed kind.

SUMMARY OF THE INVENTION

The invention entails a concept which simultaneously solves the difficulty discussed above in relation to extrusion of circular cross-section tubes in a translucent light diffusive material, and provides the means by which the housings may be mounted in a variety of applications. Specifically, the proposal of the invention is to form at least two longitudinally extending integral keys on the exterior of the tube.

The invention accordingly provides, in a first aspect, a housing for a strip lighting device, including:

- an elongated tube which is preferably of substantially circular cross-section and is at least partially translucent; and
- at least two longitudinally extending keys of substantially uniform cross-section on the exterior of said tube;
- wherein said keyways are integrally formed with the tube, extend parallel to the axis of the tube, and preferably define an included angle between them at the axis less than 180°.

In a preferred embodiment, the keys are of round or rectangular cross-section, and said defined angle is preferably of the order of 120°, or at least between 90 and 150°. Advantageously, the keys are equi-angularly distant from a diametral plane parallel to the mounted position of a support strip for internal light sources, defined by formations on the interior of the tube.

In an advantageous arrangement, each key is radially or chordally aligned with a pair of ribs defining a groove to receive a support strip or other strip within the tube.

The key may be a rib or fin, groove or shoulder.

In a second aspect, the invention is directed to a strip lighting device which includes:

- an elongate housing according to the first aspect of the invention;
- a multiplicity of light sources arranged at intervals within the housing; and
- means to diffuse, disperse or scatter light from said light sources whereby on activation of the light sources, a visible optical effect is produced when the housing is viewed from the outside.

Preferably, said effect is that the housing glows so as to form a strip or line of light.

Preferably, the means to diffuse, disperse or scatter light consists of or at least includes the housing itself.

Advantageously, the housing is a colour, e.g. a primary colour, such that the strip lighting device is visible as a housing of that colour when the light sources within are not activated, and is a glowing form of that colour when the light sources are activated.

In an advantageous application, said device may be shaped and/or connected together to form an illuminated display symbol or set of symbols, e.g. a numeral or letter of the alphabet, a larger number, word or script.

In a third aspect, the invention is directed to a support element for retaining and mounting a housing according to the first aspect for a strip lighting device according to the second aspect of the invention, which element includes a body, an opening through or recess in the body of a shape adapted to complement the elongated tube of said housing, and a pair of formations associated with said opening or recess to engage and locate the respective longitudinally extending keys of the housing of the first aspect of the invention.

In a preferred form of the support element, a projecting member has said recess at one of its ends, and said formations are on deflectable tips whereby said housing may be snap engaged with the support element by being pushed between said tips until said formations engage and locate the respective keys.

In a still further, fourth, aspect of the invention, there is provided a strip lighting system including:

- a plurality of strip lighting devices according to the second aspect of the invention; and
- a plurality of support elements according to the third aspect of the invention.

In this fourth aspect of the invention, there is also afforded a method of providing a building or other object with display or decorative illumination, including fitting the building or other object with plural strip lighting devices according to the second aspect of the invention by means of support elements according to the third aspect of the invention.

BRIEF DESCRIPTION OF THE DRAWINGS

The invention will be further described, by way of example only, with reference to the accompanying drawings, in which.

PREFERRED EMBODIMENTS

Figure 1:
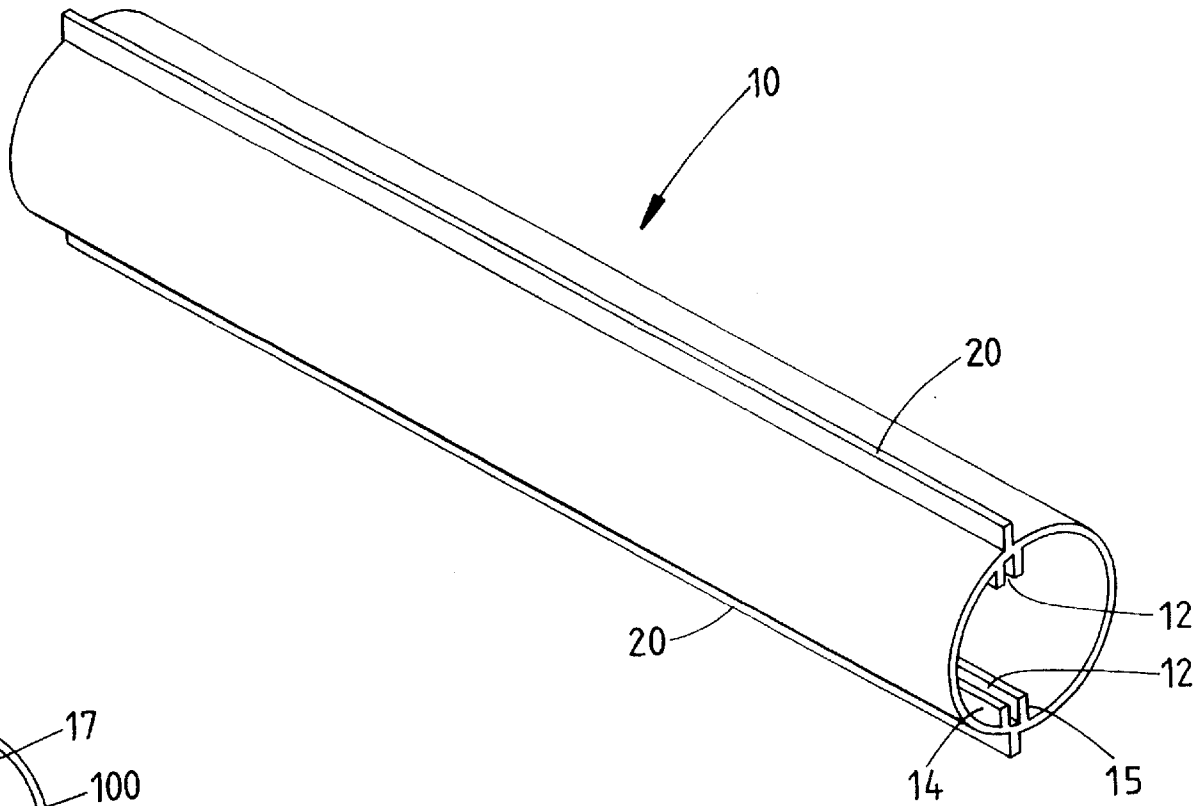
FIG. 1 is a perspective view of a tubular housing for a strip lighting device according to an embodiment of the first aspect of the invention.
Figure 2:
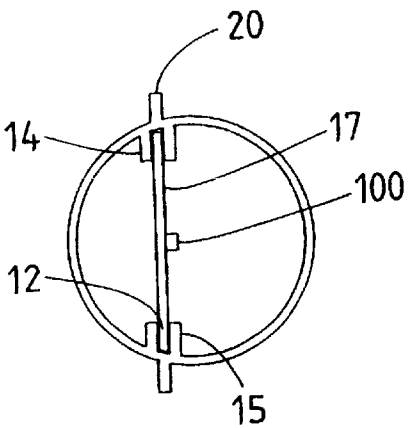
FIG. 2 is a cross-section of the housing illustrated in FIG. 1, with a PCB in position.

The housing for a strip lighting device illustrated in FIGS. 1 and 2 comprises a tube 10 of uniform thin wall cross-section, extruded in a polycarbonate plastics material of a composition such that the tube is of a substantially uniform colour, is translucent, and diffuses or disperses light emitted by light sources within. By virtue of this last property, when the tube 10 is viewed from the outside with the light sources within activated, the tube appears to glow as a strip of light. The concept of a strip lighting device of this kind, utilising LEDs as the light sources, is described in the present applicant's co-pending international patent application PCT/AU98/00602.

Tube 10 has a wall thickness, e.g. in the range 0.5 to 3.0 mm eg about 1.4 to 1.8 mm, appropriate to permit bending of the tube either directly or by heat softening and deformation. Preferably, the tube is directly mechanically bendable for at least larger radius curves, though it may be necessary to heat-soften the tube to achieve smaller radius curves.

The tubular extrusion has two further integrally formed features. On the inside, a pair of opposed mounting grooves 12 is defined by respective pairs of close spaced longitudinal ribs 14, 15 arranged so that the grooves can slidably mount a flat strip in a chordal position within the tube, subtending an angle of about 120° at the axis. In the assembled strip lighting device, this tube is typically a printed circuit board (PCB) 17 (FIGS. 2, 4) which mounts LED light sources 100 at spaced intervals and also embodies a circuit layout for powering the LEDs. Again, the general principles of the use of these strips is described in the aforementioned international patent application. There may be further mounting grooves defined by ribs within the tube, for example to mount diffuser strips or other accessories.

The other feature formed integrally on the tube 10 comprises a pair of lateral longitudinally extending ribs or fins 20. These fins are generally rectangular and arranged to be co-planar with grooves 12 and thereby in the same plane as the strip received into the grooves. Fins 20 extend parallel to the axis of the tube and generally define an included angle between them at this axis around 120°.

Fins 20 have at least two benefits. Firstly, in the process of extruding the tubes, they provide a continuous key for preventing rotation of the moulding as it progresses, the tooling being designed with matching elements to form the fins and thereby to guide them and prevent rotation.

A second benefit of fins 20 is that they may be used to support tubes 10 in a highly flexible mounting system. Combined with the ability to bend circular cross-section tubes of this form through a variety of angles by heat softening and deformation, the flexibility of the housing will be readily apparent.

Figure 3:
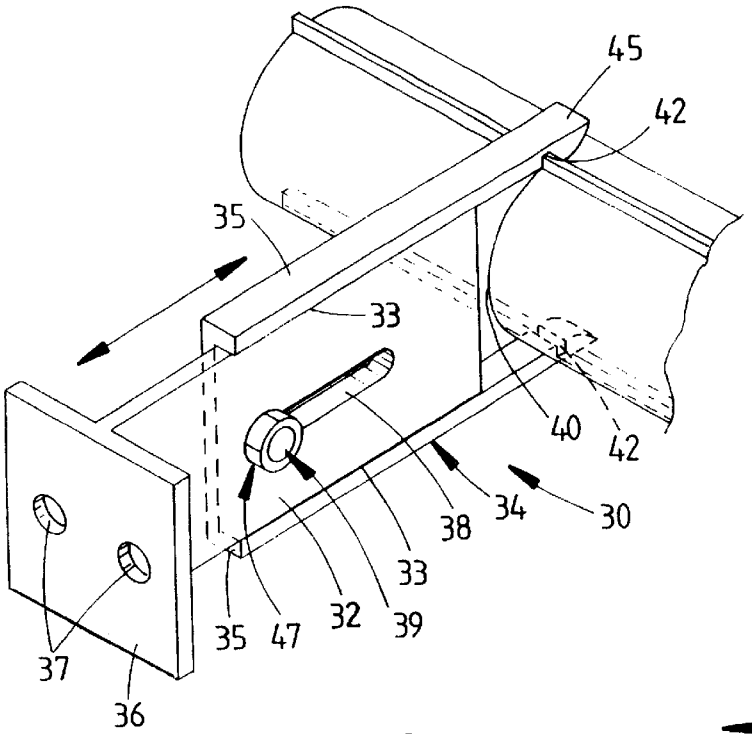
FIG. 3 illustrates an adjustable bracket for mounting the housing to a fixing point.
Figure 4:
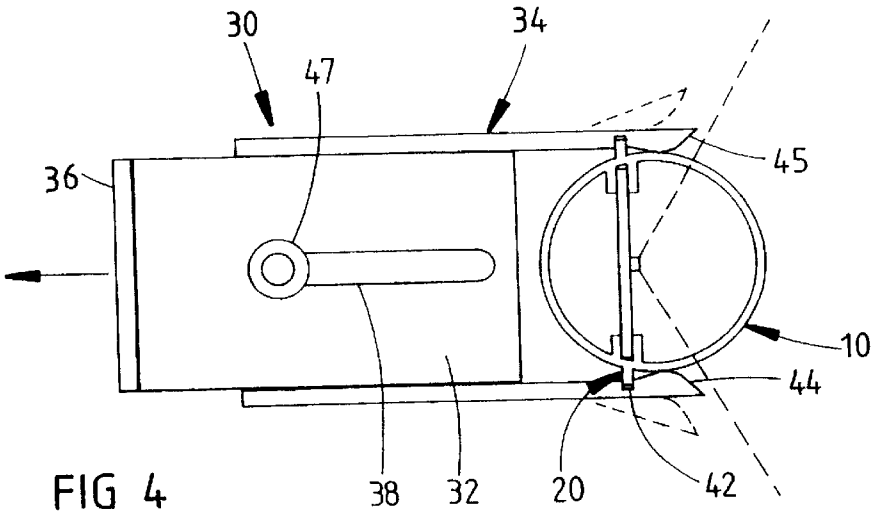
FIG. 4 is a side elevation of the bracket depicted in FIG. 3, here shown with a housing in position.

FIGS. 3 and 4 are two views of a simple adjustable mounting bracket for supporting a tube 10. The bracket 30 comprises an inner plate 32 and an outer shallow rectangular channel 34. Plate 32 projects at right angles from a flat tab 36 with apertures 37 by which it may be fixed at any desired site, e.g. to a wall, upright or rail. Plate 32 is slidably received within channel 34 and retained both by return lips 33 on the flanges 35 of the channel and by a stud 47 on the channel that in turn slidably engages a slot 38 in the plate 32. The two components may be locked at any selected position with a locking nut 39 on stud 47 to determine the setting of the tube with respect to the support to which tab 36 is fixed.

At its outer end, channel 34 is shaped to define a seat for tube 10, including a part circular recess 40 to engage the smaller side of the tube behind fins 20, and lateral slots 42 for the fins 20. The projecting tips 45 of the channel flanges 35 beyond slots 42 have opposed rounded faces 44 and are deformable so that a tube 10 can be pushed into position by pressing the fins 20 against these rounded faces 44 to deflect the tips 45 apart and so allow the fins to snap engage slots 42. This action latches the tube in position. Use of a tool or hand to press the tips 45 back apart will in turn allow release of the tube from its seat.

It will be appreciated from FIG. 4 that flange tips 45 are curved and tapered back so that they do not significantly block the outwardly expanding core of light 102 emitted by each LED 100 and diffused by the material of tube 10. The off-centre position of PCB strip 17 further facilitates this divergent beam output.

Figure 6:
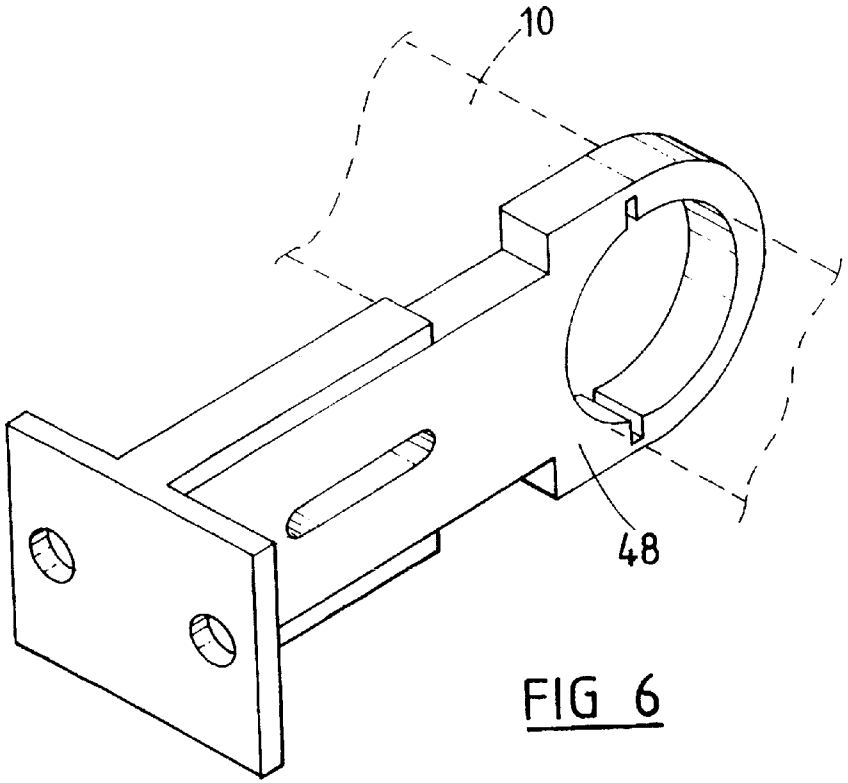
FIGS. 5 and 6 show alternative mountings for the tubular housings.
Figure 5:
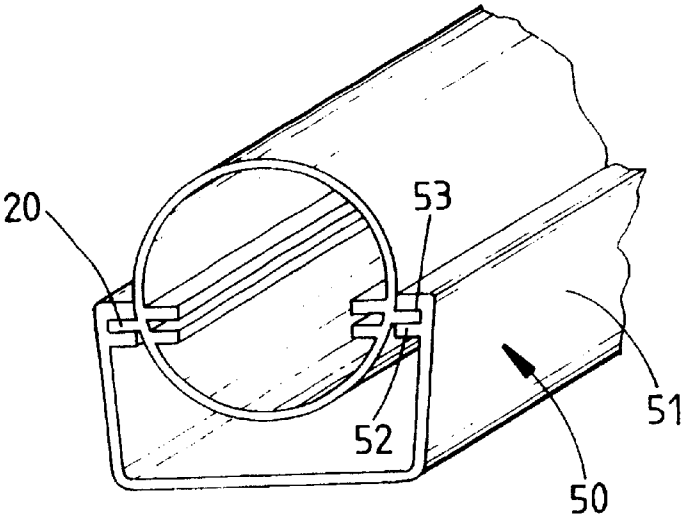

FIGS. 5 and 6 show two alternative mountings. The embodiment of FIG. 5 is a longitudinally extending channel-shaped mounting rail 50 with return lips 52 at the open edge of its flanges 51 that define grooves 53 to receive fins 20: this rail may be deflectable in a similar manner to the bracket of FIGS. 3 and 4, or may be rigid to receive the tubes 10 by sliding engagement. Also depicted, in FIG. 6, is a modified form of the bracket 40 in which the snap engaging seat is replaced with a suitably profiled ring 48 to receive a tube in a sliding/push through version.

Figure 7:
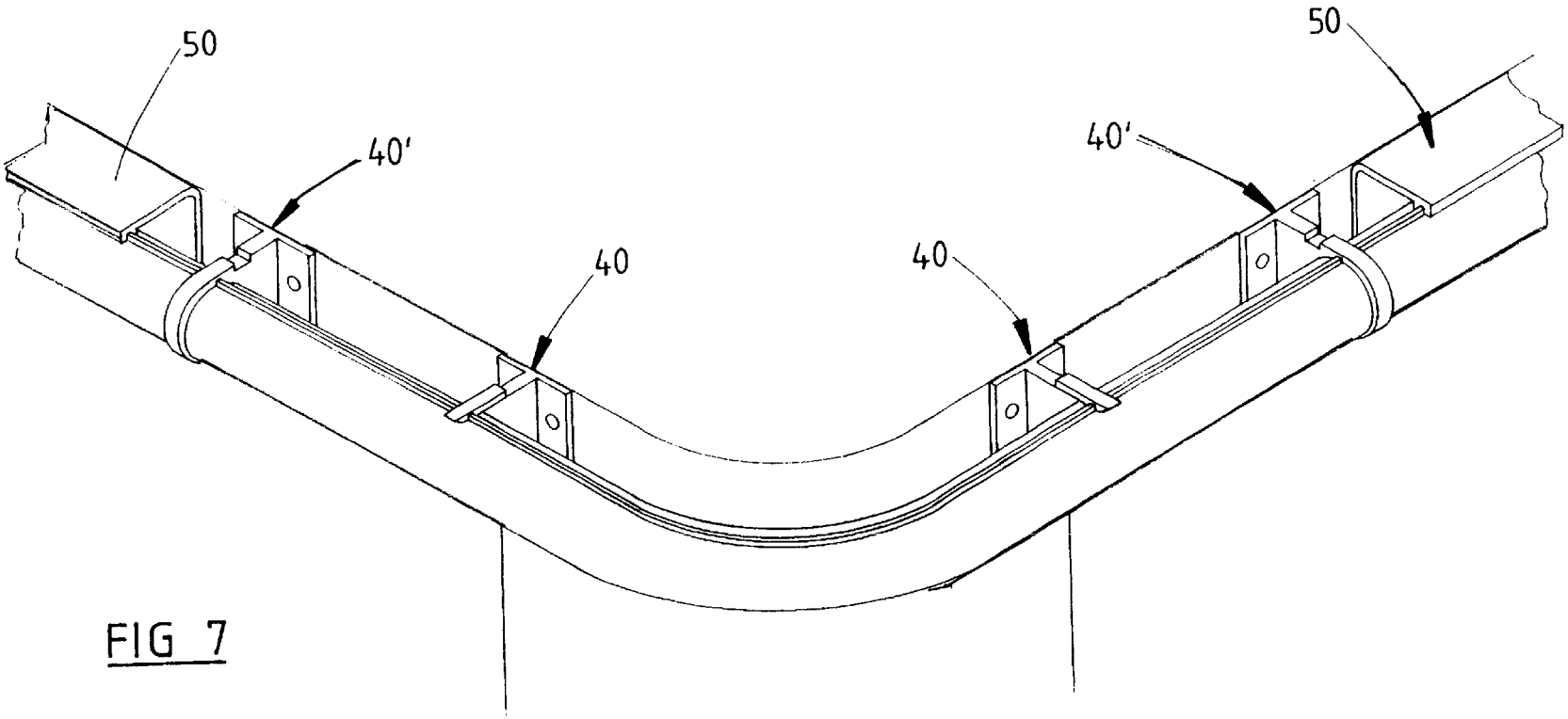
FIGS. 7 and 8 depict alternative arrangements for mounting a housing to go around a corner.
Figure 8:
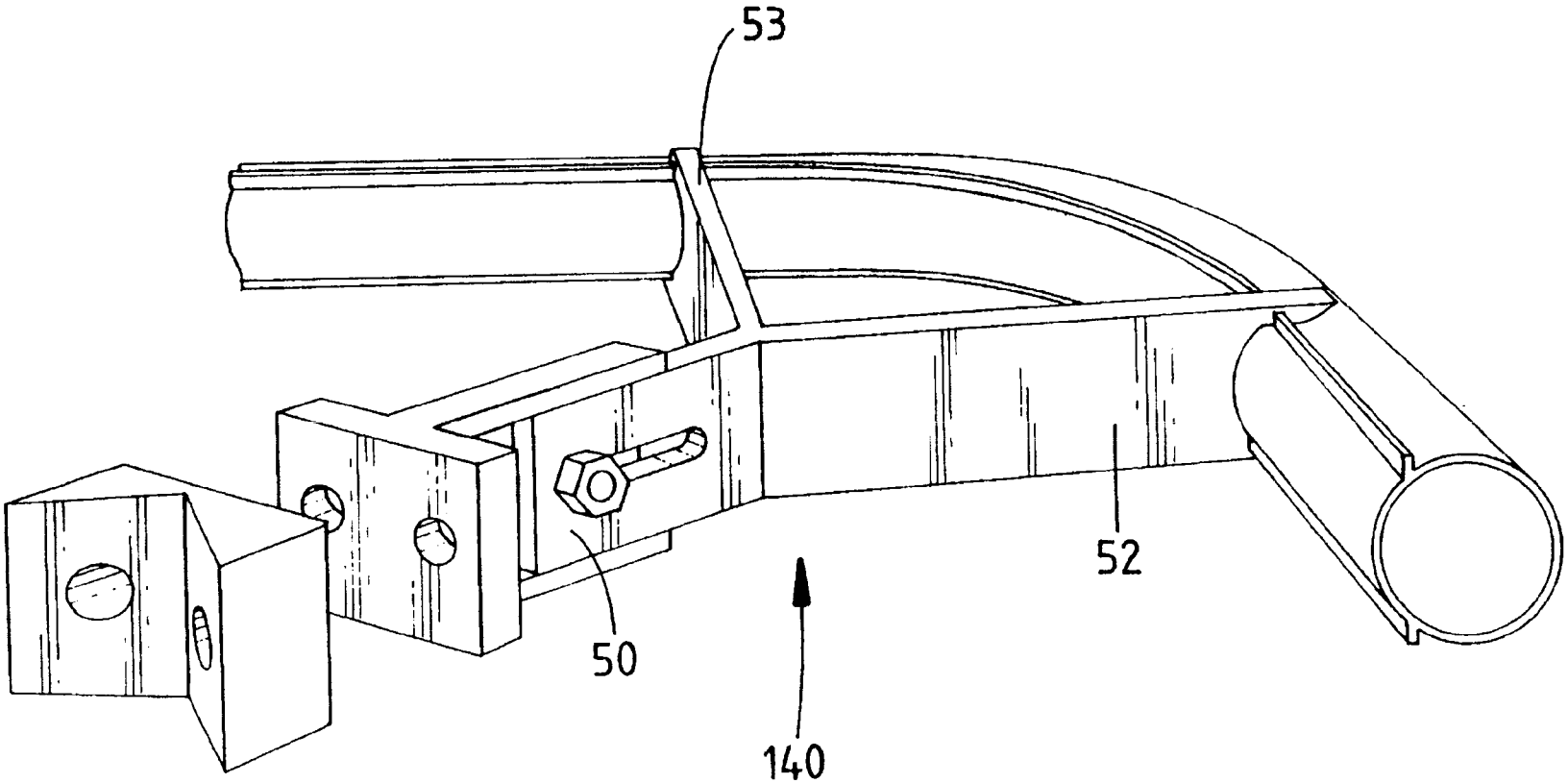

FIGS. 7 and 8 show two approaches to traversing a corner in a structure to which a tube 10 or line of connected tubes is to be fixed. Polycarbonate tubes of circular suitably thin-walled cross-section as illustrated in FIGS. 1 and 2 are capable of being bent through substantial angles, such as the 90° shown in FIG. 7, by controlled bending while softened by heat. FIG. 7 shows how a tube bent in this way can be fixed by a pair of brackets 40 at the bend and then by channels 50 on the straight walls adjacent the bend, but perhaps aided by ring brackets 40'.

FIG. 8 depicts an alternative arrangement in which the separate brackets 40 are replaced by a modified form 140 of this bracket in which the channel carries the mounting tab and the slidably received plate 50 is forked to provide a pair of angularly projecting arms 52, 53 to snap engage the tube.

Figures 15, 16, 18:
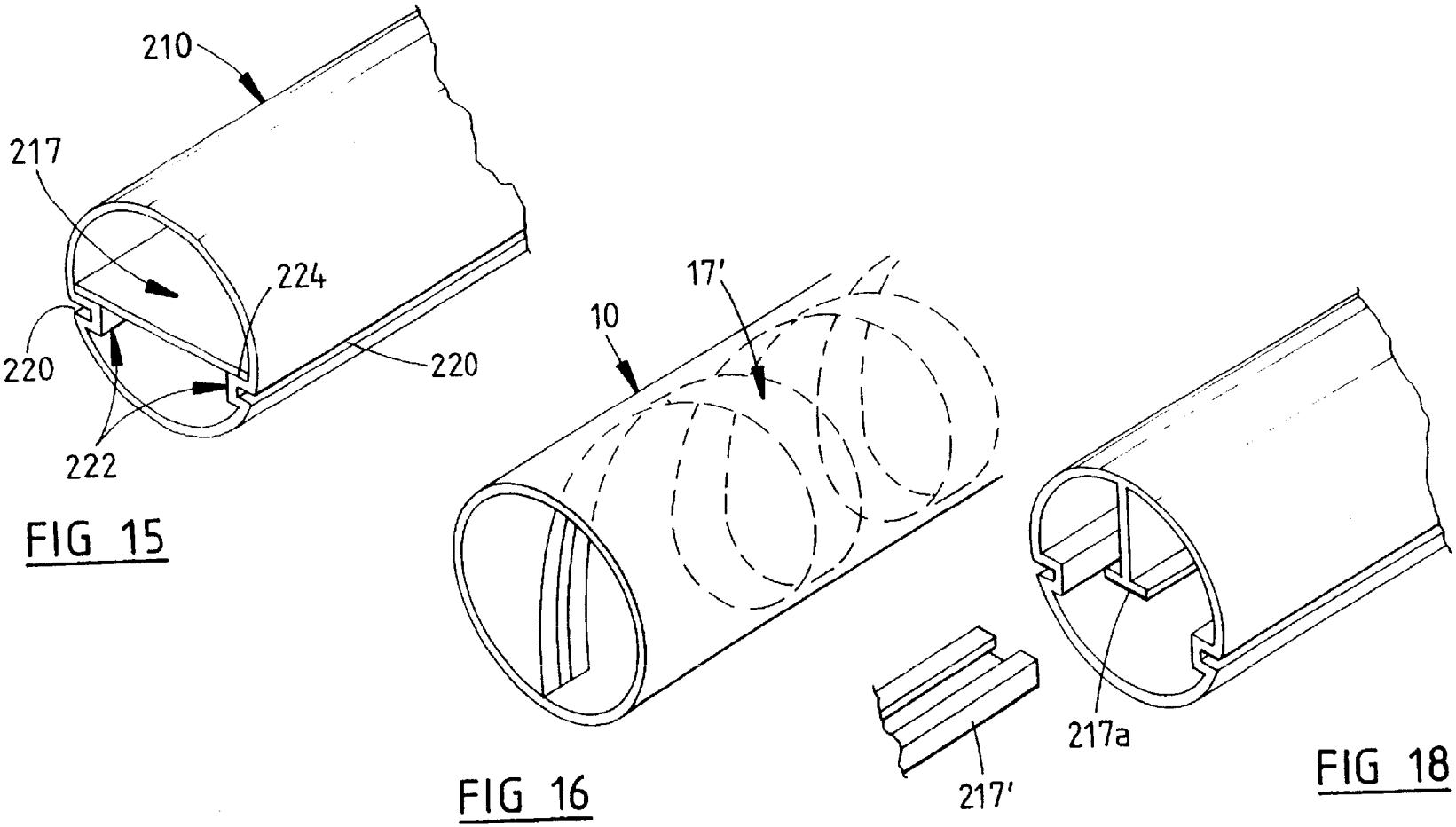
FIG. 15 shows an alternative embodiment of tubular housing in which the longitudinal key is a slot or groove.
FIG. 16 depicts, in 3-dimensional schematic view, one arrangement by which the contained PCB strip might be mounted so as to be bendable with the tube.
FIG. 18 shows a still further variation of PCB strip support.
Figure 17:
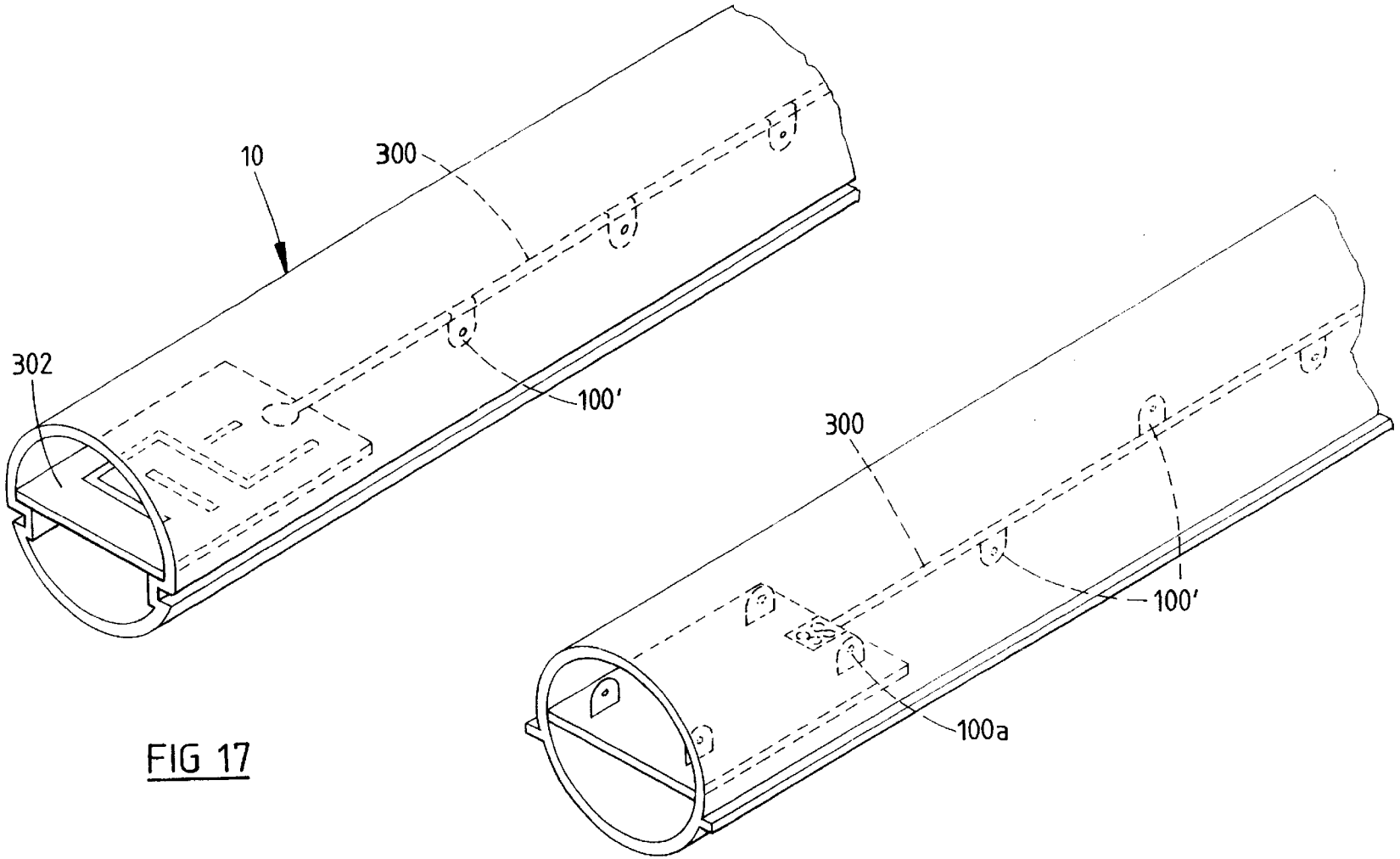
FIG. 17 is a diagram showing two variations of another arrangement.

It will of course be appreciated that bending of tubes 10 into varied curved shapes requires the mounting of the LEDs to be correspondingly adaptable. Two alternative ways of addressing this issue are illustrated in FIGS. 16 and 17. FIG. 16 depicts a PCB strip 17' held within the tube 10 in the shape of a spiral. In the configuration of FIG. 17, the PCB strip is replaced by a cable 300 supporting LEDs 100' at intervals, between end strip fittings 302 that may also carry LEDs 100*a*.

Figure 9:
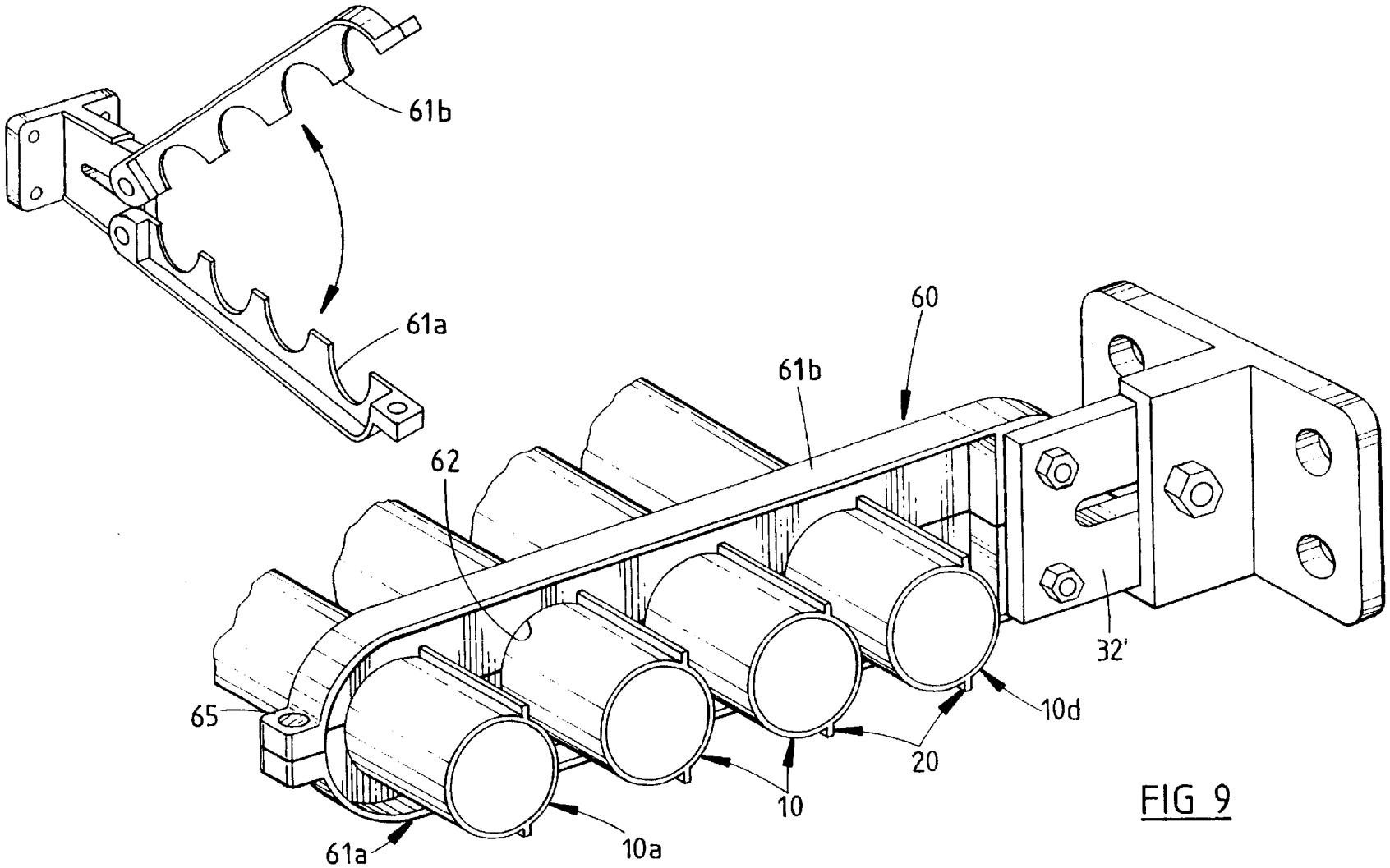
FIG. 9 shows, in two views, an arrangement for fixing four housings in an array.
Figure 11:
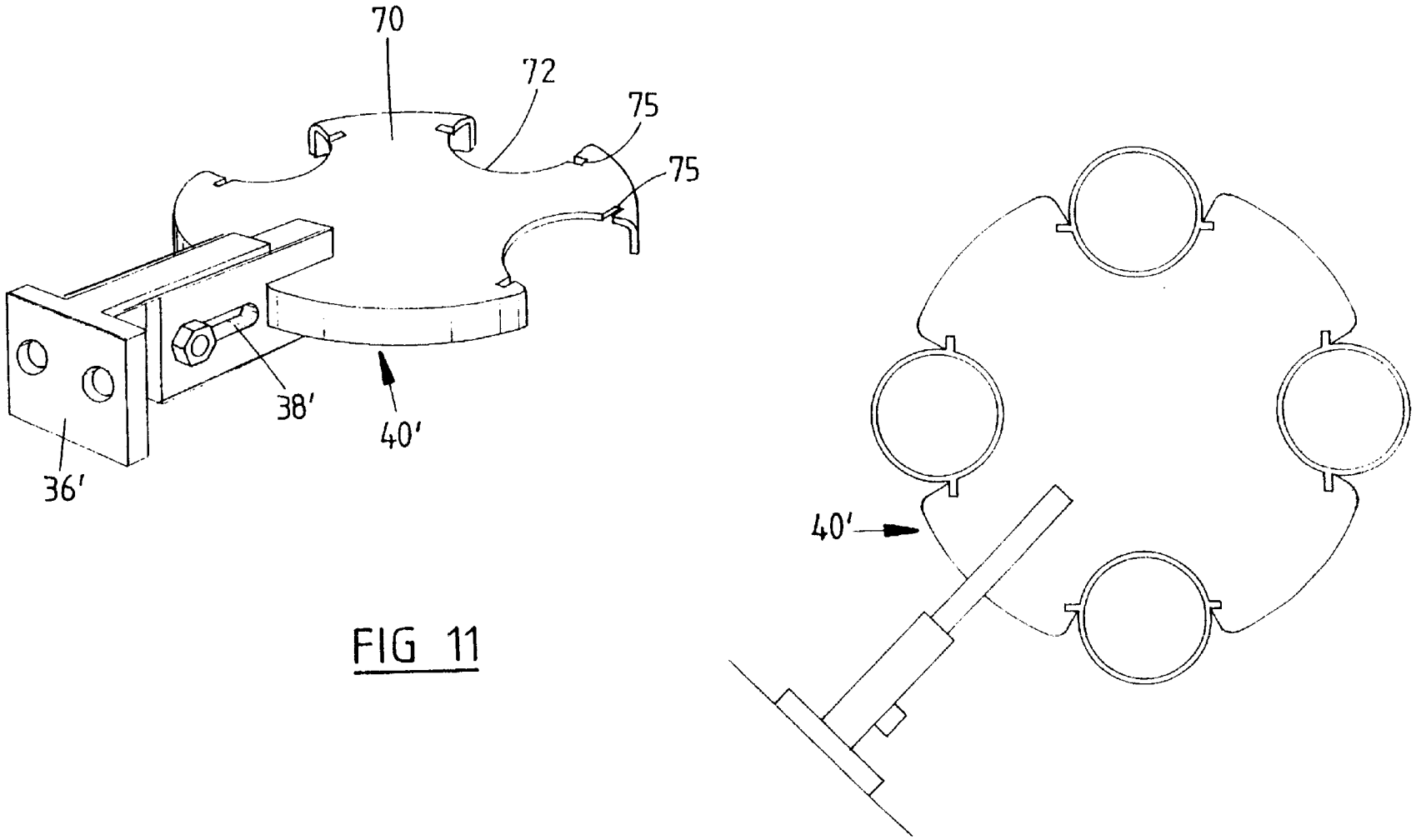
FIG. 11 illustrates an alternative form of multiple array mounting for 3 or 4 tubular housings.

FIGS. 9 and 11 illustrate exemplary alternative arrangements for fixing multiple tubes in an array. In the arrangement of FIG. 9, a slide plate 32', which is mounted and adjustable in a manner similar to the earlier bracket, is fitted with an extension arm 60 formed by two jaws 61*a*, 61*b* with matching semi-circular recesses 62 that co-operate to clamp onto four parallel tubes 10*a* to 10*d*. Each recess 62 has a slot 63 to receive a respective fin 20 of the tube. Typically, the lower jaw 61*a* would remain horizontal while the upper jaw 61*b* would tilt up, the two being locked together at their outer end by a locking nut 65.

Figure 10:
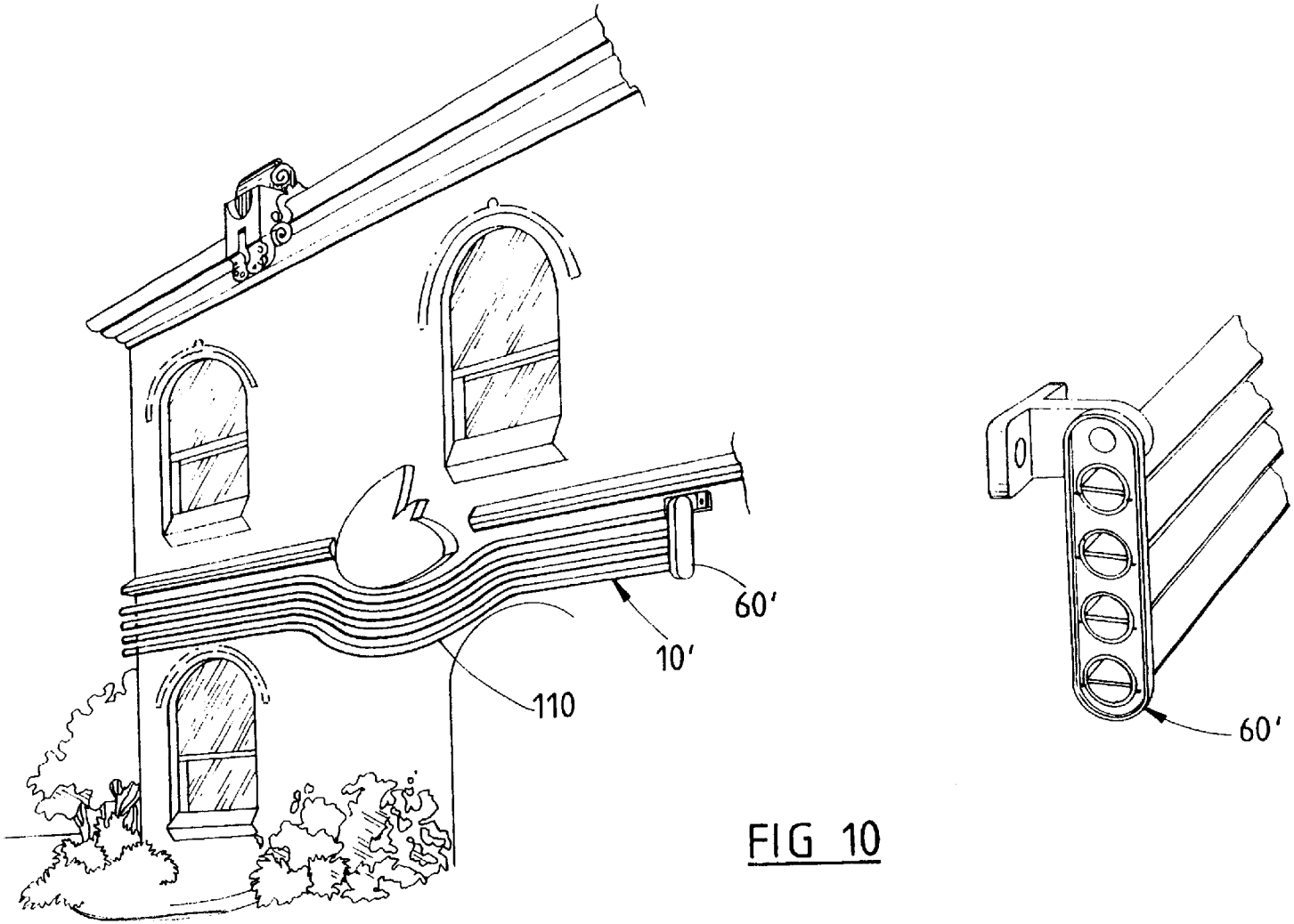
FIG. 10 demonstrates an application of the array depicted in FIG. 9.

FIG. 10 illustrates a modification and application of the four tube array shown in FIG. 9. Four tubes 10" of different colours and with a co-operating curved segment 110 may be arranged along the wall of a building, being fixed by depending bracket mounting 60' which also doubles as an end cap.

FIG. 10 in particular depicts an important advantage of the strip lighting system. The coloured tubes 10' have an attractive coloured and decorative appearance whether or not the internally contained LED light sources are activated. By day, the tubes are attractive and enhance the structure on which they are disposed; by night, the LEDs may be activated to cause the tubes to appear to glow as illuminated strips of a colour generally determined by the colour of the tubes.

FIG. 11 illustrates a modification 40' of the earlier bracket by way of a generally round disc-like holder 70 with angularly spaced cutouts 72 to receive and mount three or four tubes in a triangular, square or diamond array. Each cutout 72 has opposed slots 75 to receive fins 20 and thereby hold the tubes laterally in place.

Figure 12:
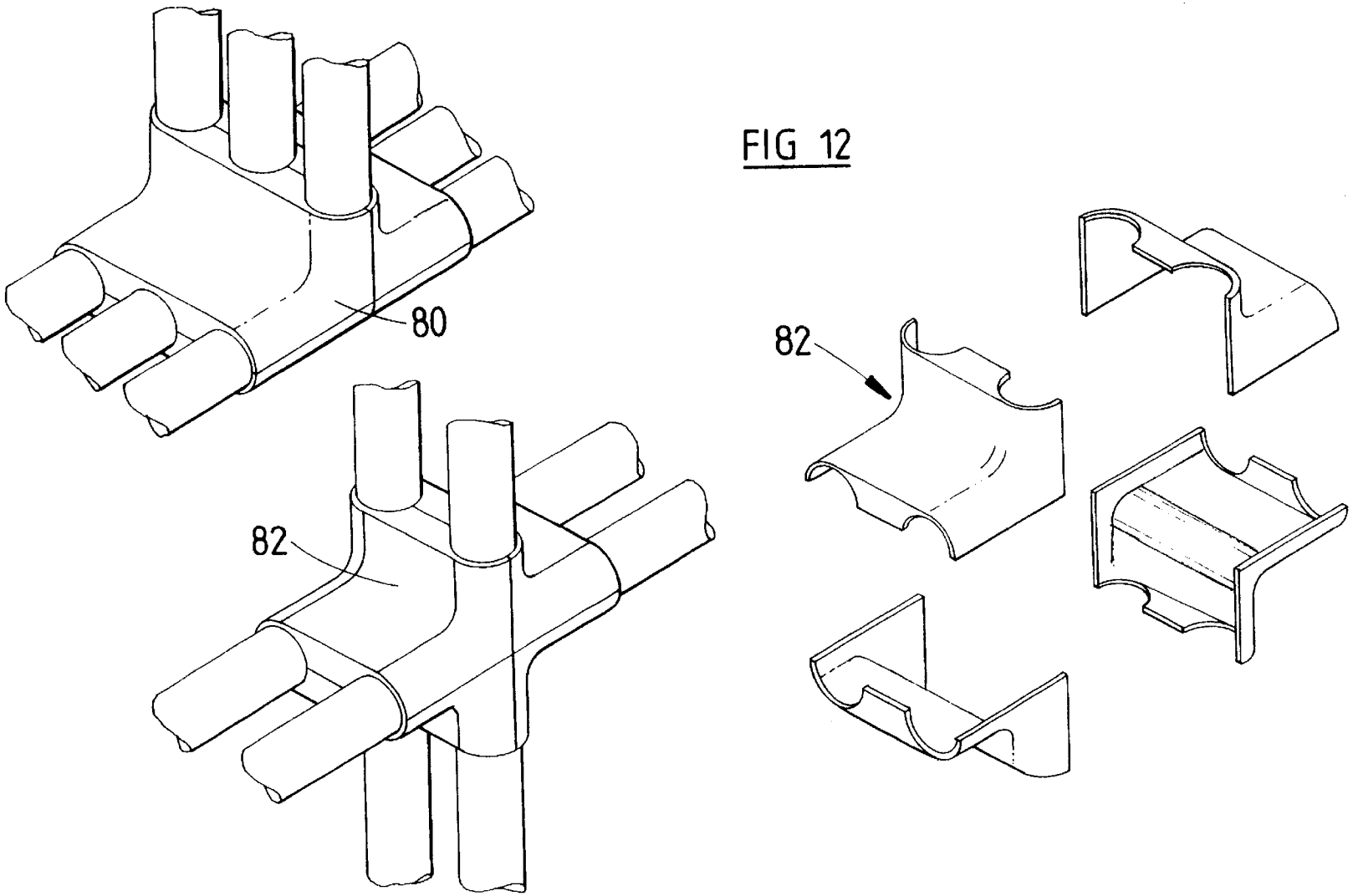
FIG. 12 is a simple illustration of a four-way buckle connector.
Figure 13:
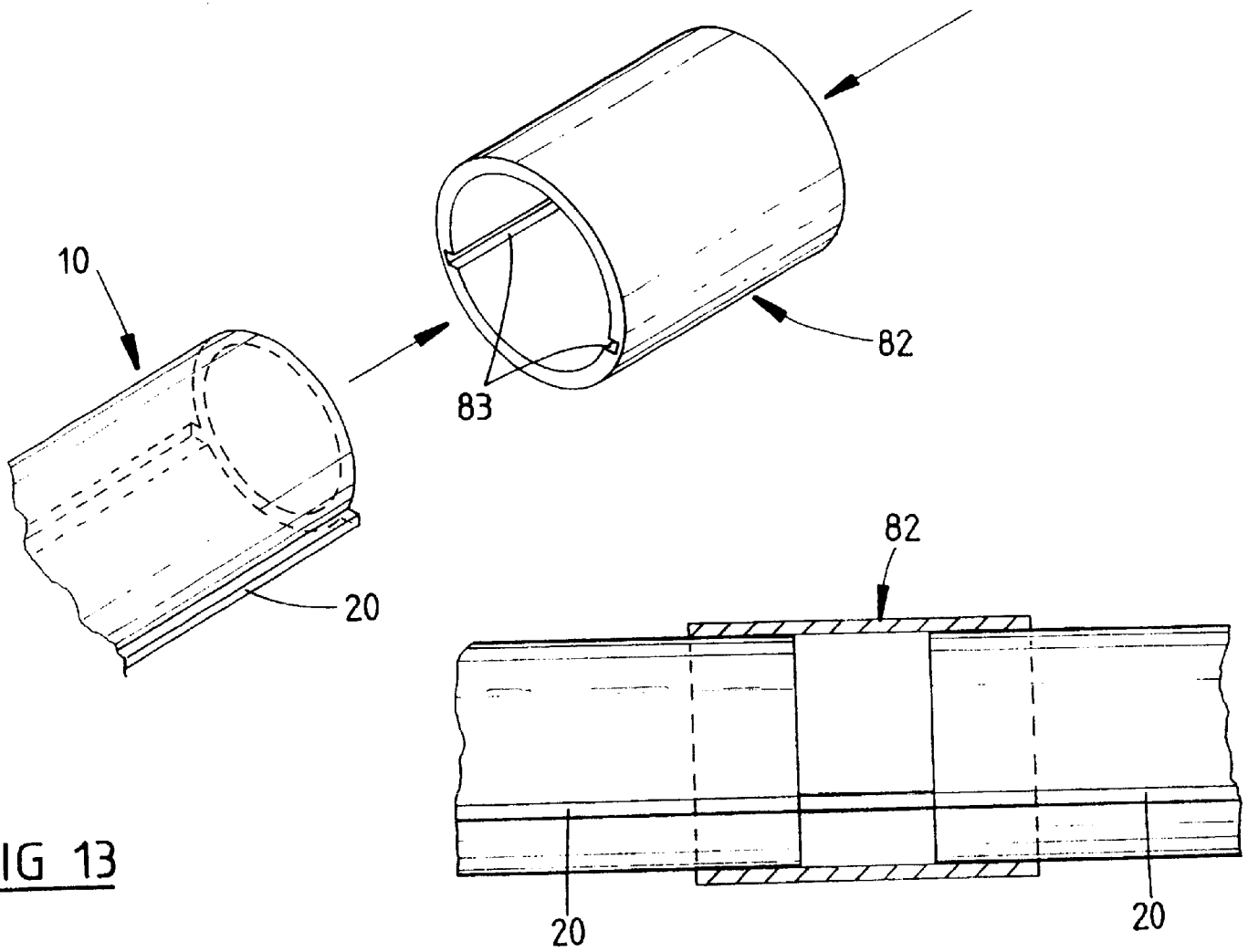
FIG. 13 illustrates a suitable sleeve connector.
Figure 14:
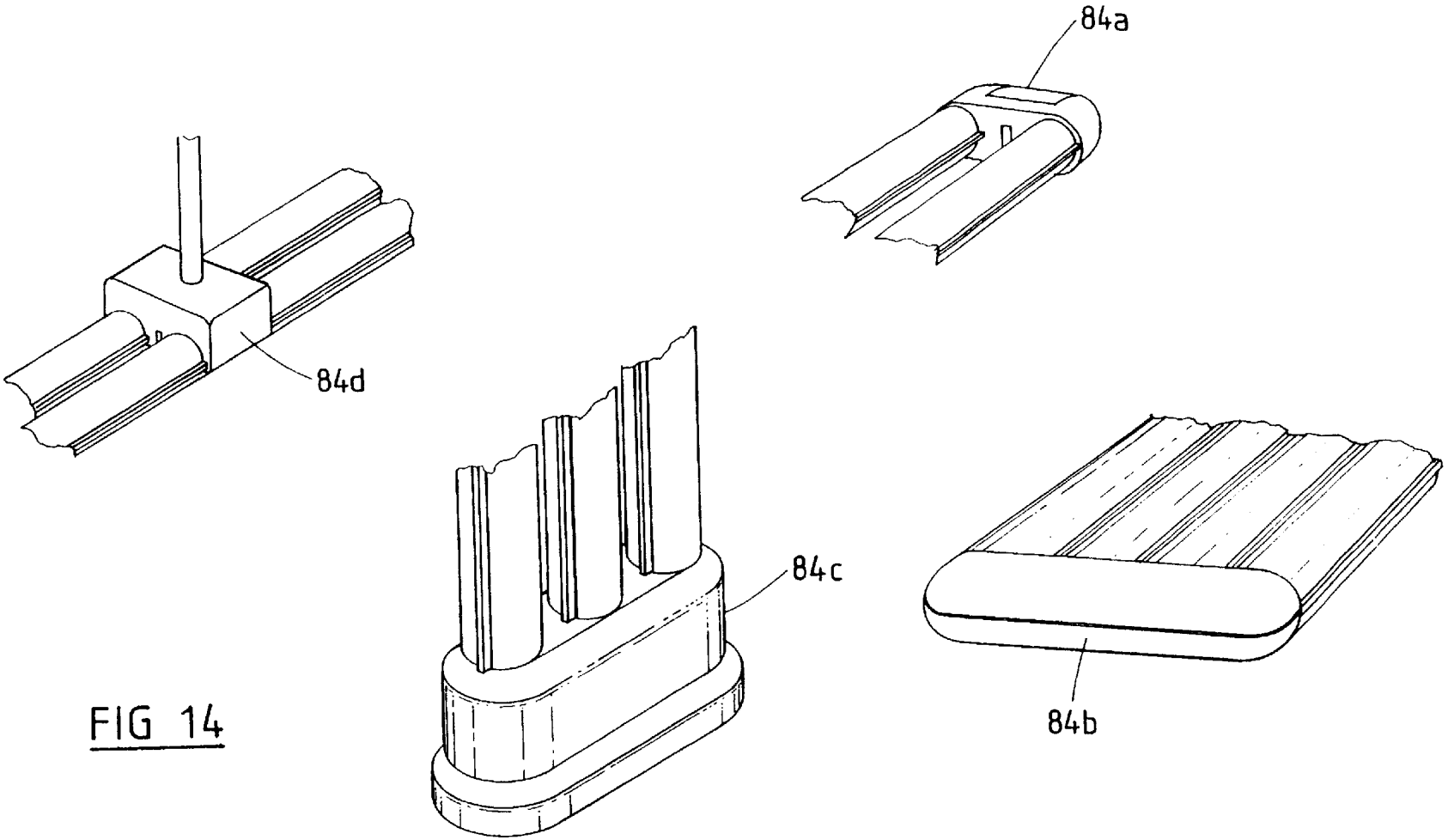
FIG. 14 illustrates forms of end cap.

FIGS. 12 to 14 respectively depict other components for a strip lighting system incorporating tubes according to the illustrated embodiment of the invention. These comprise three-way and four-way junction knuckles 80, 82, (FIG. 12) a simple sleeve connector 82 with side groove 83 for fins 20, shown co-axially linking a pair of aligned tubes 10, 10*a* (FIG. 13), and various forms of end cap 84*a* to 84*d*. These would typically incorporate fittings to electrically link the PCB strips of the tubes being terminated into an external power supplier and control circuit (FIG. 14).

In the above embodiments, an external longitudinal fin 20 serves as a key for preventing rotation during extension and for facilitating location and mounting of the tube. This key may of course be the converse, ie a groove or slot extending along the body of the tube. Such a configuration is illustrated in FIG. 15; here, each slot or groove 220 is provided by an internally protruding outwardly open channel ridge 222 in the extruded tube 210. The resultant internal shoulders 224 serve as alternative seats for the PCB strip 217. FIG. 18 shows a further alternative for supporting the LEDs: a narrow board 217' with opposed channels for sliding engagement on a T-section rib 217*a*.

Figure 19:
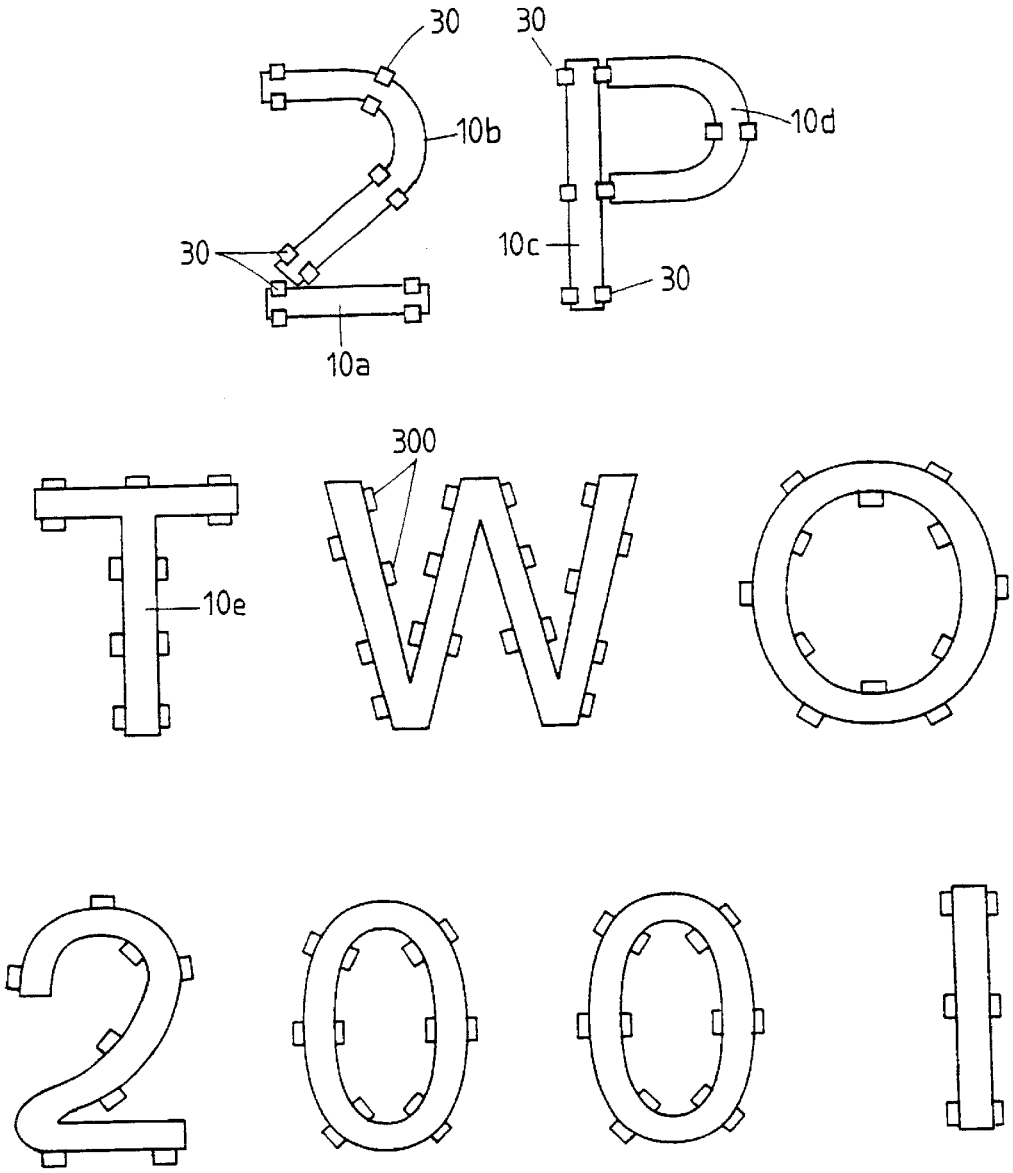
FIG. 19 depicts illuminated display symbols formed from housings according to the invention.

Various applications of strip lighting devices are described in the aforementioned international patent application, and these are incorporated herein by cross-reference. Because the housings of the present invention are suitable for bending into shapes, and adaptable to a variety of support techniques, an application of particular possible interest is as display symbols, e.g. numerals or letters of the alphabet, along the lines of neon signs. FIG. 19 depicts examples for the numerals 2 and 2001, the letter P and the word TWO. The respective component tubes are indicated at 10*a*, 10*b*, 10*c* etc. As indicated by the two 2s, multiple or single tubes may be employed, as can complex shapes eg T. In two of the examples, decorative external LEDs are indicated at 300. It should be noted that the separate letters or numerals may if desired be connected to mimic continuous script.

What is claimed is:

1. A housing for a strip lighting device, comprising:

an elongated tube which is at least partially translucent; and at least two longitudinally extending keys of substantially uniform cross-section on the exterior of said tube;

wherein said keys are integrally formed with the tube, and extend substantially parallel with the axis of the tube.

2. A housing as claimed in claim 1, wherein said elongated tube has a substantially circular cross-section.

3. A housing as claimed in claim 1, wherein said keys define an included angle between the keys of less than 180° at the axis of the tube.

4. A housing as claimed in claim 3, wherein said included angle is between 90° and 150°.

5. A housing as claimed in claim 3, wherein said included angle is about 120°.

6. A housing as claimed in claim 1, wherein said keys have a generally round cross-section.

7. A housing as claimed in claim 1, wherein said keys have a generally rectangular cross-section.

8. A housing as claimed in claim 1, further comprising longitudinally extending formations integrally formed on the inside of said elongate tube for mounting a support strip for internal light sources, wherein said formations and said keys are relatively positioned so that the keys are generally equi-angularly distant from a diametral plane parallel to the plane of the support strip when mounted using said formations in said elongate housing.

9. A housing as claimed in claim 8, wherein each said key is radially or chordally aligned with said formations.

10. A housing as claimed in claim 8, wherein said formations consist of a pair of ribs defining a groove to receive a strip within the tube.

11. A housing as claimed in claim 1, wherein each key is a rib, fin, groove, or shoulder.

12. A housing as claimed in claim 1, wherein each key is a rib.

13. A strip lighting device comprising:

an elongated housing;

at least two longitudinally extending keys of substantially uniform cross-section on the exterior of said housing, wherein said keys are integrally formed with the housing, and extend substantially parallel with the axis of the housing;

a multiplicity of light sources arranged at intervals within the housing; and a diffuser to disperse or scatter light from said light sources whereby on activation of the light sources, a visible optical effect is produced when the housing is viewed from its outside.

14. A strip lighting device as claimed in claim 13, wherein said effect is that the housing glows so as to form a strip or line of light.

15. A strip lighting device as claimed in claim 13, wherein the diffuser comprises the housing itself.

16. A strip lighting device as claimed in claim 13, wherein the housing is tinted a colour so that the strip lighting device:

is visible as that colour when the light sources within the housing are not activated, and is visible as a glowing form of that colour when the light sources within the housing are activated.

17. A strip lighting device as claimed in claim 13, wherein said device is shaped or connected together with other strip lighting devices to form an illuminated display of one or more symbols.

18. A strip lighting device as claimed in claim 17, wherein said one or more symbols include a numeral or letter of an alphabet.

19. A strip lighting device as claimed in claim 13, wherein each key is a rib, fin, groove, or shoulder.

20. The strip lighting device as claimed in claim 13 further comprising a plurality of interconnected housings interconnected by a plurality of support elements.

21. A support element for retaining and mounting a housing for a strip lighting device, said housing comprising: an elongated tube which is at least partially translucent; at least two longitudinally extending keys of substantially uniform cross-section on the exterior of said tube, wherein said keys are integrally formed with the tube, and extend substantially parallel with the axis of the tube, the support element comprising:

a body;

an opening or recess in the body, the opening or recess having a shape adapted to receive the elongated tube of said housing; and a pair of formations associated with said opening or recess to engage and locate the respective longitudinally extending keys of said housing.

22. A support element as claimed in claim 21, including deflectable members located at an open end of said recess, said formations being formed on said deflectable members whereby said housing may be snap engaged with the support element by pushing said housing between said deflectable members until said formations engage and locate the respective keys.

23. A method of providing a building or other object with display or decorative illumination, comprising fitting the building or other object with plural strip lighting devices, each strip lighting device comprising:

an elongated housing;

at least two longitudinally extending keys of substantially uniform cross-section on the exterior of said housing, wherein said keys are integrally formed with the housing, and extend substantially parallel with the axis of the housing;

a multiplicity of light sources arranged at intervals within the housing; and a diffuser to disperse or scatter light from said light sources whereby on activation of the light sources, a visible optical effect is produced when the housing is viewed from its outside.

* * * * *